US009934915B2

(12) United States Patent
Cao et al.

(10) Patent No.: US 9,934,915 B2
(45) Date of Patent: Apr. 3, 2018

(54) REDUCED LAYER KEYBOARD STACK-UP

(71) Applicant: APPLE INC., Cupertino, CA (US)

(72) Inventors: Robert Y. Cao, Cupertino, CA (US); Dinesh C. Mathew, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 14/736,151

(22) Filed: Jun. 10, 2015

(65) Prior Publication Data

US 2016/0365204 A1 Dec. 15, 2016

(51) Int. Cl.

| | |
|---|---|
| ***H01H 9/26*** | (2006.01) |
| ***H01H 13/702*** | (2006.01) |
| ***H01H 13/02*** | (2006.01) |
| ***H01H 13/704*** | (2006.01) |
| ***H01H 13/705*** | (2006.01) |
| *H01H 3/12* | (2006.01) |

(52) U.S. Cl.

CPC ..... *H01H 13/702* (2013.01); *H01H 13/023* (2013.01); *H01H 13/704* (2013.01); *H01H 13/705* (2013.01); *H01H 3/125* (2013.01); *H01H 2209/03* (2013.01); *H01H 2215/006* (2013.01); *H01H 2219/036* (2013.01); *H01H 2223/034* (2013.01); *H01H 2231/042* (2013.01)

(58) Field of Classification Search

CPC .... H01H 2219/062; H01H 3/12; H01H 13/70; G06F 3/0202; G06F 1/1662

USPC ..... 200/5 A, 314, 344; 400/490, 472; 362/23.03; 361/679.08

See application file for complete search history.

(56) References Cited

U.S. PATENT DOCUMENTS

| | | | |
|---|---|---|---|
| 3,657,492 | A | 4/1972 | Arndt et al. |
| 3,917,917 | A | 11/1975 | Murata |
| 3,978,297 | A | 8/1976 | Lynn et al. |
| 4,095,066 | A | 6/1978 | Harris |
| 4,319,099 | A | 3/1982 | Asher |
| 4,349,712 | A | 9/1982 | Michalski |
| 4,484,042 | A | 11/1984 | Matsui |
| 4,596,905 | A | 6/1986 | Fowler |
| 4,598,181 | A | 7/1986 | Selby |
| 4,670,084 | A | 6/1987 | Durand et al. |
| 4,755,645 | A | 7/1988 | Naoki et al. |
| 4,937,408 | A | 6/1990 | Hattori et al. |

(Continued)

FOREIGN PATENT DOCUMENTS

| | | |
|---|---|---|
| CN | 2155620 | 2/1994 |
| CN | 2394309 | 8/2000 |

(Continued)

OTHER PUBLICATIONS

U.S. Appl. No. 15/014,596, filed Feb. 3, 2016, pending.

(Continued)

*Primary Examiner* — Vanessa Girardi

(74) *Attorney, Agent, or Firm* — Brownstein Hyatt Farber Schreck, LLP

(57) ABSTRACT

Disclosed herein is a stack-up for an input device. The stack-up may include a flexible substrate having a switch and a light source. The switch has at least two contacts that are bridged in response to actuation of a dome that is positioned above the switch. The flexible substrate includes a signal trace for detecting the actuation of the dome and a power trace for providing power to the light source.

19 Claims, 5 Drawing Sheets

(56) References Cited

U.S. PATENT DOCUMENTS 4,987,275 A 1/1991 Miller et al.
5,021,638 A 6/1991 Nopper et al.
5,092,459 A 3/1992 Uljanic et al.
5,136,131 A 8/1992 Komaki
5,278,372 A 1/1994 Takagi et al.
5,280,146 A 1/1994 Inagaki et al.
5,340,955 A 8/1994 Calvillo et al.
5,382,762 A 1/1995 Mochizuki
5,408,060 A 4/1995 Muurinen
5,421,659 A 6/1995 Liang
5,422,447 A 6/1995 Spence
5,457,297 A 10/1995 Chen
5,477,430 A 12/1995 LaRose et al.
5,481,074 A 1/1996 English
5,504,283 A 4/1996 Kako et al.
5,512,719 A 4/1996 Okada et al.
5,625,532 A 4/1997 Sellers
5,804,780 A 9/1998 Bartha
5,828,015 A 10/1998 Coulon
5,847,337 A 12/1998 Chen
5,874,700 A 2/1999 Hochgesang
5,875,013 A 2/1999 Takahara
5,876,106 A 3/1999 Kordecki et al.
5,878,872 A 3/1999 Tsai
5,881,866 A 3/1999 Miyajima et al.
5,898,147 A 4/1999 Domzaiski et al.
5,924,555 A 7/1999 Sadamori et al.
5,935,691 A 8/1999 Tsai
5,960,942 A 10/1999 Thornton
5,986,227 A 11/1999 Hon
6,020,565 A 2/2000 Pan
6,068,416 A * 5/2000 Kumamoto ..... H01H 3/125 200/344
6,215,420 B1 4/2001 Harrison et al.
6,257,782 B1 7/2001 Maruyama et al.
6,259,046 B1 7/2001 Iwama et al.
6,377,685 B1 4/2002 Krishnan
6,388,219 B2 5/2002 Hsu et al.
6,423,918 B1 7/2002 King et al.
6,482,032 B1 11/2002 Szu et al.
6,530,283 B2 3/2003 Okada et al.
6,538,801 B2 3/2003 Jacobson et al.
6,542,355 B1 4/2003 Huang
6,552,287 B2 4/2003 Janniere
6,556,112 B1 4/2003 Van Zeeland et al.
6,559,399 B2 5/2003 Hsu et al.
6,560,612 B1 5/2003 Yamada et al.
6,572,289 B2 6/2003 Lo et al.
6,573,463 B2 6/2003 Ono
6,585,435 B2 7/2003 Fang
6,624,369 B2 9/2003 Ito et al.
6,706,986 B2 3/2004 Hsu
6,738,050 B2 5/2004 Comiskey
6,750,414 B2 6/2004 Sullivan
6,759,614 B2 7/2004 Yoneyama
6,762,381 B2 7/2004 Kunthady et al.
6,765,503 B1 7/2004 Chan et al.
6,788,450 B2 9/2004 Kawai et al.
6,797,906 B2 9/2004 Ohashi
6,850,227 B2 2/2005 Takahashi et al.
6,860,660 B2 3/2005 Hochgesang et al.
6,911,608 B2 6/2005 Levy
6,926,418 B2 8/2005 Osterg.ang.rd et al.
6,940,030 B2 9/2005 Takeda et al.
6,977,352 B2 12/2005 Oosawa
6,979,792 B1 12/2005 Lai
6,987,466 B1 1/2006 Welch et al.
6,987,503 B2 1/2006 Inoue
7,012,206 B2 3/2006 Oikawa
7,030,330 B2 4/2006 Suda
7,038,832 B2 5/2006 Kanbe
7,129,930 B1 10/2006 Cathey et al.
7,134,205 B2 11/2006 Bruennel
7,146,701 B2 12/2006 Mahoney et al.
7,151,236 B2 12/2006 Ducruet et al.
7,151,237 B2 12/2006 Mahoney et al.
7,154,059 B2 12/2006 Chou
7,166,813 B2 1/2007 Soma
7,172,303 B2 2/2007 Shipman et al.
7,189,932 B2 3/2007 Kim
7,256,766 B2 8/2007 Albert et al.
7,283,119 B2 10/2007 Kishi
7,301,113 B2 * 11/2007 Nishimura ..... H01H 13/48 200/406
7,312,790 B2 12/2007 Sato et al.
7,378,607 B2 5/2008 Koyano et al.
7,385,806 B2 6/2008 Liao
7,391,555 B2 6/2008 Albert et al.
7,414,213 B2 8/2008 Hwang
7,429,707 B2 9/2008 Yanai et al.
7,432,460 B2 10/2008 Clegg
7,510,342 B2 3/2009 Lane et al.
7,531,764 B1 5/2009 Lev et al.
7,541,554 B2 6/2009 Hou
7,589,292 B2 9/2009 Jung et al.
7,639,187 B2 12/2009 Caballero et al.
7,639,571 B2 12/2009 Ishii et al.
7,679,010 B2 3/2010 Wingett
7,724,415 B2 5/2010 Yamaguchi
7,781,690 B2 8/2010 Ishii
7,813,774 B2 10/2010 Perez-Noguera
7,842,895 B2 11/2010 Lee
7,847,204 B2 12/2010 Tsai
7,851,819 B2 12/2010 Shi
7,866,866 B2 1/2011 Wahlstrom
7,893,376 B2 2/2011 Chen
7,923,653 B2 4/2011 Ohsumi
7,947,915 B2 5/2011 Lee et al.
7,999,748 B2 8/2011 Ligtenberg et al.
8,063,325 B2 11/2011 Sung et al.
8,077,096 B2 12/2011 Chiang et al.
8,080,744 B2 12/2011 Yeh et al.
8,098,228 B2 1/2012 Shimodaira et al.
8,109,650 B2 2/2012 Chang et al.
8,119,945 B2 2/2012 Lin
8,124,903 B2 2/2012 Tatehata et al.
8,134,094 B2 3/2012 Tsao et al.
8,143,982 B1 3/2012 Lauder et al.
8,156,172 B2 4/2012 Muehl et al.
8,178,808 B2 5/2012 Strittmatter et al.
8,184,021 B2 5/2012 Chou
8,212,160 B2 7/2012 Tsao
8,212,162 B2 7/2012 Zhou
8,218,301 B2 7/2012 Lee
8,232,958 B2 7/2012 Tolbert
8,246,228 B2 8/2012 Ko et al.
8,253,048 B2 8/2012 Ozias et al.
8,253,052 B2 9/2012 Chen
8,263,887 B2 9/2012 Chen et al.
8,289,280 B2 10/2012 Travis
8,299,382 B2 10/2012 Takemae et al.
8,317,384 B2 11/2012 Chung et al.
8,319,298 B2 11/2012 Hsu
8,325,141 B2 12/2012 Marsden
8,330,725 B2 12/2012 Mahowald et al.
8,354,629 B2 * 1/2013 Lin ..... F21V 33/006 250/205
8,378,857 B2 2/2013 Pance
8,383,972 B2 2/2013 Liu
8,384,566 B2 2/2013 Bocirnea
8,404,990 B2 3/2013 Lutgring et al.
8,451,146 B2 3/2013 Mahowald et al.
8,431,849 B2 4/2013 Chen
8,436,265 B2 5/2013 Koike et al.
8,462,514 B2 6/2013 Myers et al.
8,500,348 B2 8/2013 Dumont et al.
8,502,094 B2 8/2013 Chen
8,542,194 B2 9/2013 Akens et al.
8,548,528 B2 10/2013 Kim et al.
8,569,639 B2 10/2013 Strittmatter
8,575,632 B2 11/2013 Kuramoto et al.
8,581,127 B2 11/2013 Jhuang et al.
8,592,699 B2 11/2013 Kessler et al.
8,592,702 B2 11/2013 Tsai

(56) References Cited

U.S. PATENT DOCUMENTS 8,592,703 B2 11/2013 Johnson et al.
8,604,370 B2 12/2013 Chao
8,629,362 B1 1/2014 Knighton et al.
8,642,904 B2 2/2014 Chiba et al.
8,651,720 B2 2/2014 Sherman et al.
8,659,882 B2 2/2014 Liang et al.
8,731,618 B2 5/2014 Jarvis et al.
8,748,767 B2 6/2014 Ozias et al.
8,759,705 B2 6/2014 Funakoshi et al.
8,760,405 B2 6/2014 Nam
8,786,548 B2 * 7/2014 Oh ..... H04M 1/22 345/158
8,791,378 B2 7/2014 Lan
8,835,784 B2 9/2014 Hirota
8,847,090 B2 9/2014 Ozaki
8,847,711 B2 9/2014 Yang et al.
8,853,580 B2 10/2014 Chen
8,854,312 B2 10/2014 Meierling
8,870,477 B2 10/2014 Merminod et al.
8,884,174 B2 11/2014 Chou et al.
8,921,473 B1 12/2014 Hyman
8,922,476 B2 12/2014 Stewart et al.
8,943,427 B2 1/2015 Heo et al.
8,976,117 B2 3/2015 Krahenbuhl et al.
8,994,641 B2 3/2015 Stewart et al.
9,007,297 B2 4/2015 Stewart et al.
9,012,795 B2 4/2015 Niu et al.
9,029,723 B2 5/2015 Pegg
9,063,627 B2 6/2015 Yairi et al.
9,064,642 B2 6/2015 Welch et al.
9,086,733 B2 7/2015 Pance
9,087,663 B2 7/2015 Los
9,093,229 B2 7/2015 Leong et al.
9,213,416 B2 12/2015 Chen
9,234,486 B2 1/2016 Das et al.
9,235,236 B2 1/2016 Nam
9,274,654 B2 3/2016 Slobodin et al.
9,275,810 B2 3/2016 Pance et al.
9,300,033 B2 3/2016 Han et al.
9,305,496 B2 4/2016 Kimura
9,443,672 B2 9/2016 Martisauskas
9,448,628 B2 9/2016 Tan et al.
9,471,185 B2 10/2016 Guard
9,477,382 B2 10/2016 Hicks et al.
9,612,674 B2 4/2017 Degner et al.
9,761,389 B2 9/2017 Leong et al.
2002/0079211 A1 6/2002 Katayama et al.
2002/0093436 A1 7/2002 Lien
2002/0113770 A1 8/2002 Jacobson et al.
2002/0149835 A1 10/2002 Kanbe
2003/0169232 A1 9/2003 Ito
2004/0004559 A1 1/2004 Rast
2004/0225965 A1 11/2004 Garside et al.
2004/0257247 A1 12/2004 Lin et al.
2005/0035950 A1 2/2005 Daniels
2005/0253801 A1 11/2005 Kobayashi
2006/0011458 A1 1/2006 Purcocks
2006/0020469 A1 1/2006 Rast
2006/0120790 A1 6/2006 Chang
2006/0181511 A1 8/2006 Woolley
2006/0243987 A1 11/2006 Lai
2007/0200823 A1 8/2007 Bytheway et al.
2007/0285393 A1 12/2007 Ishakov
2008/0131184 A1 6/2008 Brown et al.
2008/0136782 A1 6/2008 Mundt et al.
2008/0251370 A1 10/2008 Aoki
2009/0046053 A1 2/2009 Shigehiro et al.
2009/0103964 A1 4/2009 Takagi et al.
2009/0128496 A1 5/2009 Huang
2009/0262085 A1 10/2009 Wassingbo et al.
2009/0267892 A1 10/2009 Faubert
2010/0045705 A1 2/2010 Vertegaal et al.
2010/0066568 A1 3/2010 Lee
2010/0109921 A1 5/2010 Annerfors
2010/0156796 A1 6/2010 Kim et al.
2010/0253630 A1 10/2010 Homma et al.
2011/0032127 A1 2/2011 Roush
2011/0056817 A1 3/2011 Wu
2011/0056836 A1 3/2011 Tatebe et al.
2011/0205179 A1 8/2011 Braun
2011/0261031 A1 10/2011 Muto
2011/0267272 A1 11/2011 Meyer et al.
2011/0284355 A1 11/2011 Yang
2011/0303521 A1 12/2011 Niu et al.
2012/0012446 A1 1/2012 Hwa
2012/0032972 A1 2/2012 Hwang
2012/0090973 A1 4/2012 Liu
2012/0098751 A1 4/2012 Liu
2012/0286701 A1 11/2012 Yang et al.
2012/0298496 A1 11/2012 Zhang
2012/0313856 A1 12/2012 Hsieh
2013/0043115 A1 2/2013 Yang et al.
2013/0093500 A1 4/2013 Bruwer
2013/0093733 A1 4/2013 Yoshida
2013/0100030 A1 4/2013 Los et al.
2013/0120265 A1 5/2013 Horii et al.
2013/0161170 A1 6/2013 Fan et al.
2013/0215079 A1 8/2013 Johnson et al.
2013/0242601 A1 9/2013 Kloeppel et al.
2013/0270090 A1 10/2013 Lee
2013/0329396 A1 * 12/2013 Smith ..... G06F 1/1656 362/23.03
2014/0015777 A1 1/2014 Park et al.
2014/0027259 A1 1/2014 Kawana et al.
2014/0071654 A1 3/2014 Chien
2014/0082490 A1 3/2014 Jung et al.
2014/0090967 A1 4/2014 Inagaki
2014/0098042 A1 4/2014 Kuo et al.
2014/0116865 A1 5/2014 Leong et al.
2014/0118264 A1 5/2014 Leong et al.
2014/0151211 A1 6/2014 Zhang
2014/0184496 A1 7/2014 Gribetz et al.
2014/0191973 A1 7/2014 Zellers et al.
2014/0218851 A1 8/2014 Klein et al.
2014/0252881 A1 9/2014 Dinh et al.
2014/0291133 A1 10/2014 Fu et al.
2014/0320436 A1 10/2014 Modarres et al.
2014/0346025 A1 11/2014 Hendren et al.
2014/0375141 A1 12/2014 Nakajima
2015/0016038 A1 1/2015 Niu et al.
2015/0083561 A1 3/2015 Han et al.
2015/0090570 A1 4/2015 Kwan et al.
2015/0090571 A1 4/2015 Leong et al.
2015/0227207 A1 8/2015 Winter et al.
2015/0243457 A1 8/2015 Niu et al.
2015/0270073 A1 9/2015 Yarak, III et al.
2015/0277559 A1 10/2015 Vescovi et al.
2015/0287553 A1 10/2015 Welch et al.
2015/0309538 A1 10/2015 Zhang
2015/0332874 A1 11/2015 Brock et al.
2015/0348726 A1 12/2015 Hendren
2015/0378391 A1 12/2015 Huitema et al.
2016/0049266 A1 2/2016 Stringer et al.
2016/0093452 A1 3/2016 Zercoe et al.
2016/0172129 A1 6/2016 Zercoe et al.
2016/0189890 A1 6/2016 Leong et al.
2016/0189891 A1 6/2016 Zercoe et al.
2016/0259375 A1 9/2016 Andre et al.
2016/0329166 A1 11/2016 Hou et al.
2016/0336124 A1 11/2016 Leong et al.
2016/0336127 A1 11/2016 Leong et al.
2016/0336128 A1 11/2016 Leong et al.
2016/0343523 A1 11/2016 Hendren et al.
2016/0351360 A1 12/2016 Knopf et al.
2016/0378234 A1 12/2016 Ligtenberg et al.
2016/0379775 A1 12/2016 Leong et al.
2017/0004939 A1 1/2017 Kwan et al.
2017/0011869 A1 1/2017 Knopf et al.
2017/0090106 A1 3/2017 Cao et al.

FOREIGN PATENT DOCUMENTS

CN 1533128 9/2004
CN 1542497 11/2004

(56) References Cited

FOREIGN PATENT DOCUMENTS

| | | |
|---|---|---|
| CN | 2672832 | 1/2005 |
| CN | 1624842 | 6/2005 |
| CN | 1812030 | 8/2006 |
| CN | 1838036 | 9/2006 |
| CN | 1855332 | 11/2006 |
| CN | 101051569 | 10/2007 |
| CN | 200961844 | 10/2007 |
| CN | 200986871 | 12/2007 |
| CN | 101146137 | 3/2008 |
| CN | 201054315 | 4/2008 |
| CN | 201084602 | 7/2008 |
| CN | 201123174 | 9/2008 |
| CN | 201149829 | 11/2008 |
| CN | 101315841 | 12/2008 |
| CN | 201210457 | 3/2009 |
| CN | 101438228 | 5/2009 |
| CN | 101465226 | 6/2009 |
| CN | 101494130 | 7/2009 |
| CN | 101502082 | 8/2009 |
| CN | 201298481 | 8/2009 |
| CN | 101546667 | 9/2009 |
| CN | 101572195 | 11/2009 |
| CN | 101800281 | 8/2010 |
| CN | 101807482 | 8/2010 |
| CN | 101868773 | 10/2010 |
| CN | 201655616 | 11/2010 |
| CN | 102110542 | 6/2011 |
| CN | 102119430 | 7/2011 |
| CN | 201904256 | 7/2011 |
| CN | 102163084 | 8/2011 |
| CN | 201927524 | 8/2011 |
| CN | 201945951 | 8/2011 |
| CN | 201945952 | 8/2011 |
| CN | 201956238 | 8/2011 |
| CN | 102197452 | 9/2011 |
| CN | 202008941 | 10/2011 |
| CN | 202040690 | 11/2011 |
| CN | 102280292 | 12/2011 |
| CN | 102338348 | 2/2012 |
| CN | 102375550 | 3/2012 |
| CN | 202205161 | 4/2012 |
| CN | 102496509 | 6/2012 |
| CN | 10269527 | 8/2012 |
| CN | 102622089 | 8/2012 |
| CN | 102629526 | 8/2012 |
| CN | 202372927 | 8/2012 |
| CN | 102679239 | 9/2012 |
| CN | 102683072 | 9/2012 |
| CN | 202434387 | 9/2012 |
| CN | 202523007 | 11/2012 |
| CN | 102832068 | 12/2012 |
| CN | 102955573 | 3/2013 |
| CN | 102956386 | 3/2013 |
| CN | 102969183 | 3/2013 |
| CN | 103000417 | 3/2013 |
| CN | 103165327 | 6/2013 |
| CN | 103180979 | 6/2013 |
| CN | 203012648 | 6/2013 |
| CN | 203135988 | 8/2013 |
| CN | 103377841 | 10/2013 |
| CN | 103489986 | 1/2014 |
| CN | 203414880 | 1/2014 |
| CN | 103681056 | 3/2014 |
| CN | 103699181 | 4/2014 |
| CN | 203520312 | 4/2014 |
| CN | 203588895 | 5/2014 |
| CN | 103839715 | 6/2014 |
| CN | 103839720 | 6/2014 |
| CN | 103839722 | 6/2014 |
| CN | 103903891 | 7/2014 |
| CN | 103956290 | 7/2014 |
| CN | 203733685 | 7/2014 |
| CN | 104021968 | 9/2014 |
| CN | 204102769 | 1/2015 |
| CN | 204117915 | 1/2015 |
| CN | 104517769 | 4/2015 |
| CN | 204632641 | 9/2015 |
| CN | 105097341 | 11/2015 |
| DE | 2530176 | 1/1977 |
| DE | 3002772 | 7/1981 |
| DE | 29704100 | 4/1997 |
| DE | 202008001970 | 8/2008 |
| EP | 0441993 | 8/1991 |
| EP | 1835272 | 9/2007 |
| EP | 1928008 | 6/2008 |
| EP | 2022606 | 6/2010 |
| EP | 2426688 | 3/2012 |
| EP | 2439760 | 4/2012 |
| EP | 2463798 | 6/2012 |
| EP | 2664979 | 11/2013 |
| FR | 2147420 | 3/1973 |
| FR | 2911000 | 7/2008 |
| FR | 2950193 | 3/2011 |
| GB | 1361459 | 7/1974 |
| JP | S50115562 | 9/1975 |
| JP | S60055477 | 3/1985 |
| JP | S61172422 | 10/1986 |
| JP | S62072429 | 4/1987 |
| JP | S63182024 | 11/1988 |
| JP | H0422024 | 4/1992 |
| JP | H0520963 | 1/1993 |
| JP | H0524512 | 8/1993 |
| JP | H05342944 | 12/1993 |
| JP | H09204148 | 8/1997 |
| JP | H10312726 | 11/1998 |
| JP | H11194882 | 7/1999 |
| JP | 2000010709 | 1/2000 |
| JP | 2000057871 | 2/2000 |
| JP | 2000339097 | 12/2000 |
| JP | 2001100889 | 4/2001 |
| JP | 2003114751 | 9/2001 |
| JP | 2002260478 | 9/2002 |
| JP | 2002298689 | 10/2002 |
| JP | 2003522998 | 7/2003 |
| JP | 2005108041 | 4/2005 |
| JP | 2006164929 | 6/2006 |
| JP | 2006185906 | 7/2006 |
| JP | 2006521664 | 9/2006 |
| JP | 2006269439 | 10/2006 |
| JP | 2006277013 | 10/2006 |
| JP | 2006344609 | 12/2006 |
| JP | 2007115633 | 5/2007 |
| JP | 2007514247 | 5/2007 |
| JP | 2007156983 | 6/2007 |
| JP | 2008021428 | 1/2008 |
| JP | 2008041431 | 2/2008 |
| JP | 2008100129 | 5/2008 |
| JP | 2008191850 | 8/2008 |
| JP | 2008533559 | 8/2008 |
| JP | 2008293922 | 12/2008 |
| JP | 2009099503 | 5/2009 |
| JP | 2009181894 | 8/2009 |
| JP | 2010061956 | 3/2010 |
| JP | 2010244088 | 10/2010 |
| JP | 2010244302 | 10/2010 |
| JP | 2011018484 | 1/2011 |
| JP | 2011065126 | 3/2011 |
| JP | 2011150804 | 8/2011 |
| JP | 2011165630 | 8/2011 |
| JP | 2011524066 | 8/2011 |
| JP | 2011187297 | 9/2011 |
| JP | 2012022473 | 2/2012 |
| JP | 2012043705 | 3/2012 |
| JP | 2012063630 | 3/2012 |
| JP | 2012098873 | 5/2012 |
| JP | 2012134064 | 7/2012 |
| JP | 2012186067 | 9/2012 |
| JP | 2012230256 | 11/2012 |
| JP | 2014017179 | 1/2014 |
| JP | 2014026807 | 2/2014 |
| JP | 2014216190 | 11/2014 |
| JP | 2014220039 | 11/2014 |
| JP | 2016053778 | 4/2016 |
| KR | 1019990007394 | 1/1999 |

(56) References Cited

FOREIGN PATENT DOCUMENTS

| | | |
|---|---|---|
| KR | 1020020001668 | 1/2002 |
| KR | 100454203 | 10/2004 |
| KR | 1020060083032 | 7/2006 |
| KR | 1020080064116 | 7/2008 |
| KR | 1020080066164 | 7/2008 |
| KR | 2020110006385 | 6/2011 |
| KR | 1020120062797 | 6/2012 |
| KR | 1020130040131 | 4/2013 |
| KR | 20150024201 | 3/2015 |
| TW | 200703396 | 1/2007 |
| TW | M334397 | 6/2008 |
| TW | 201108284 | 3/2011 |
| TW | 201108286 | 3/2011 |
| TW | M407429 | 7/2011 |
| TW | 201246251 | 11/2012 |
| TW | 201403646 | 1/2014 |
| WO | WO9744946 | 11/1997 |
| WO | WO2005/057320 | 6/2005 |
| WO | WO2006/022313 | 3/2006 |
| WO | WO2007/049253 | 5/2007 |
| WO | WO2008/045833 | 4/2008 |
| WO | WO2009/005026 | 1/2009 |
| WO | WO2012/011282 | 1/2012 |
| WO | WO2012/027978 | 3/2012 |
| WO | WO2013/096478 | 6/2013 |
| WO | WO2014175446 | 10/2014 |

OTHER PUBLICATIONS

U.S. Appl. No. 15/154,682, filed May 13, 2016, pending.
U.S. Appl. No. 15/154,706, filed May 13, 2016, pending.
U.S. Appl. No. 15/154,723, filed May 13, 2016, pending.
U.S. Appl. No. 15/154,768, filed May 13, 2016, pending.
U.S. Appl. No. 15/230,740, filed Aug. 8, 2016, pending.
U.S. Appl. No. 15/230,724, filed Aug. 8, 2016, pending.
U.S. Appl. No. 15/261,954, filed Sep. 11, 2016, pending.
U.S. Appl. No. 15/261,972, filed Sep. 11, 2016, pending.
U.S. Appl. No. 15/262,249, filed Sep. 12, 2016, pending.
U.S. Appl. No. 15/264,827, filed Sep. 14, 2016, pending.
U.S. Appl. No. 15/268,518, filed Sep. 16, 2016, pending.
U.S. Appl. No. 15/269,790, filed Sep. 19, 2016, pending.
Elekson, "Reliable and Tested Wearable Electronics Embedment Solutions," http://www.wearable.technology/our-technologies, 3 pages, at least as early as Jan. 6, 2016.

* cited by examiner

REDUCED LAYER KEYBOARD STACK-UP

FIELD

The described embodiments relate generally to an assembly for an input device. More particularly, the present embodiments relate to a keyboard stack-up for a keyboard assembly.

BACKGROUND

Electronic devices typically include one or more input devices such as keyboards, touchpads, mice, or touchscreens to enable a user to interact with the device. These input devices can be integrated into an electronic device or can stand alone as discrete devices that transmit signals to the electronic device via a wired or wireless connection.

A conventional keyboard typically includes a dome switch, two layers (typically plastic) separated by a spacer and a contact switch coupled to a printed circuit board. Upon actuation of the dome, the first layer deflects and comes into contact with the second layer. As the layers contact one another, the switch closes and ultimately provides a detectable input. However, as more layers are included in the keyboard assembly, the overall thickness of the keyboard assembly increases. When a keyboard or other input device is integrated with an electronic device, particularly small or thin form factor electronic devices, the increased thickness of the keyboard assembly or input device may be undesirable.

SUMMARY

Generally, embodiments disclosed herein are directed to an input assembly. The input assembly includes a top case defining a keyhole. The keyhole has a support structure that extends from a base of the opening to form a ledge or platform. The input assembly also includes a stack-up positioned on the support structure. The stack-up includes a substrate, an in-plane switch coupled to the substrate, and a dome positioned above the in-plane switch. The dome is adapted to cause the in-plane switch to conduct a signal in response to actuation of the dome.

Also disclosed is a stack-up for an input device. The stack-up includes a substrate. In some embodiments, the substrate may be flexible. A switch having at least two contacts is coupled to the substrate. An optional light source may also be coupled to the substrate. The stack-up also includes a dome positioned above the switch. Actuation of the dome causes a conductive material positioned above the switch to bridge the at least two contacts of the switch. The substrate contains a signal trace for detecting the actuation of the dome. When the light source is present, the substrate also includes a power trace for providing power to the light source.

In yet another embodiment, a stack-up for an input device may include a flexible substrate having a signal trace formed thereon. The stack-up also includes a switch having at least two contacts and a dome positioned above the switch. A conductive material may be integrated with a bottom surface of the dome. The conductive material of the dome bridges the at least two contacts of the switch in response to actuation of the dome.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
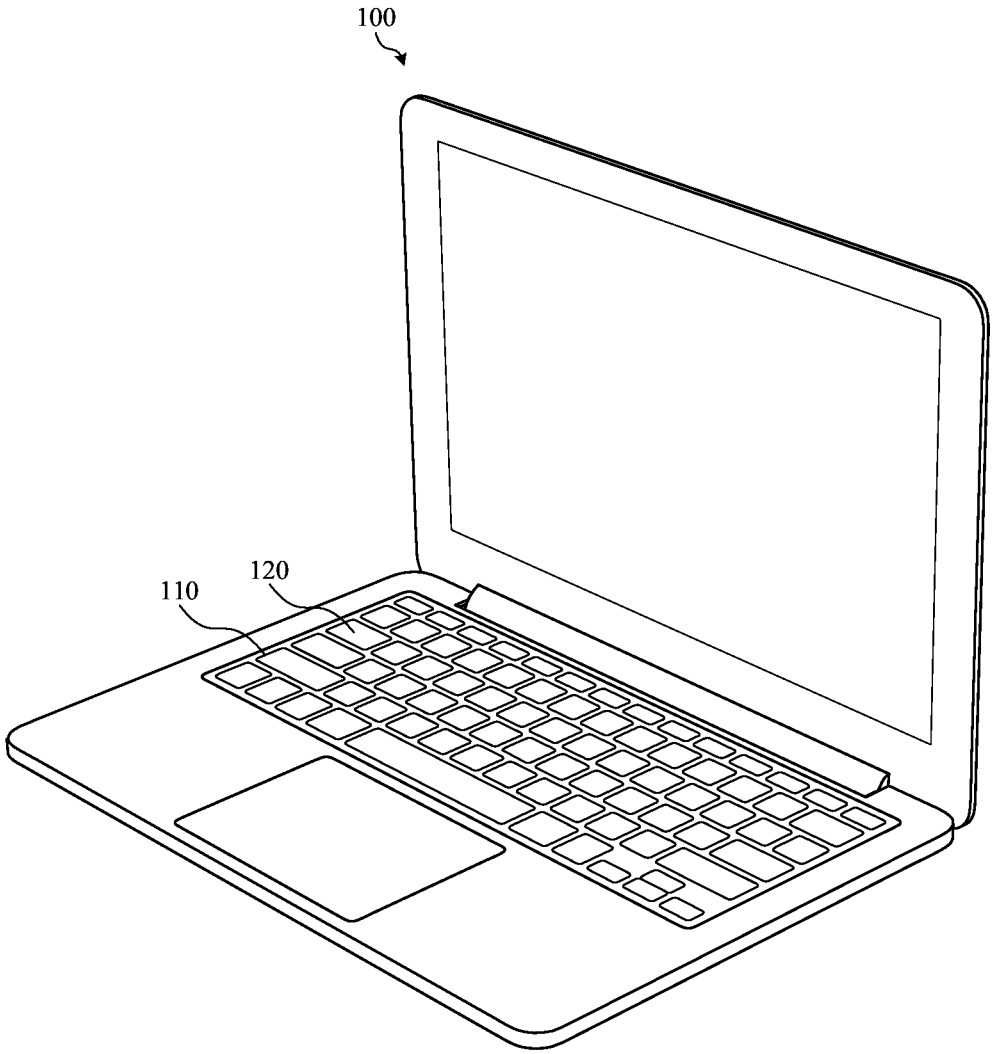
FIG. 1 illustrates an example electronic device that may use the keyboard assembly and keyboard stack-up described herein according to one or more embodiments of the present disclosure.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates generally to various layers of components that form a keyboard assembly or an input assembly for an input device. The layers of the components are referred to herein as a "stack-up." More specifically, the disclosure is directed to a reduced layer keyboard stack-up for a keyboard assembly or other input assembly of an electronic device. The stack-up may be reduced in size and some components or layers of the stack-up may be removed to reduce the overall size, dimension and/or thickness of the keyboard or input device.

Conventional keyboard stack-ups often include at least three discrete layers with each layer having a different thickness. More specifically, conventional keyboard stack-ups include a switch mounted on a polyethylene terephthalate (PET) membrane, a backlight layer that includes one or more light sources and one or more light guides, and a structural layer typically made of a stainless steel sheet metal. As the PET membrane deflects, electrical traces associated with the switch contact each other for an electrical make.

In contrast, the keyboard stack-up of the present disclosure uses a flexible substrate (such as a flex circuit) as the bottom layer for the switch. As such, one or more light sources may be coupled to the flexible substrate such that they are on the same layer as the switch. More specifically, the keyboard stack-up of the present disclosure utilizes an in-plane switch that enables the keyboard stack-up to have fewer layers, thereby reducing the overall thickness of the keyboard stack-up and any associated keyboard. Because the keyboard stack-up utilizes a flexible substrate, the keyboard stack-up, or an associated keyboard, may be manipulated, bent, or otherwise deflected, at least at particular points or portions. The reduced profile and the ability of the keyboard stack-up to be manipulated in such a manner may enable a keyboard assembly, and more particularly a top case of a keyboard assembly, to have additional support structures and/or increased thickness without increasing or unduly increasing the overall thickness of the keyboard and/or the electronic device. As such, the keyboard assembly may be used with electronic devices having a small form factor and/or a thin profile.

The reduced layer keyboard stack-up includes a flexible substrate, a dome, an in-plane switch and an optional light source. The in-plane switch and the light source are coupled to the flexible substrate. In some embodiments, the flexible substrate may also be laminated or coupled to a printed circuit board or other stiffener.

The in-plane switch includes two or more contacts that are bridged in response to contact from a conductive material. More specifically, as the dome is actuated, collapses or is otherwise compressed, a conductive material, either on a deflection layer of the stack-up or on the dome is brought into contact with the two or more contacts of the in-plane switch to conduct a signal. The signal may be transmitted along a signal trace that is embedded in or otherwise provided on the flexible substrate. In addition, a power trace may also be provided in or on the flexible substrate to provide power to the light source.

These and other embodiments are discussed below with reference to FIGS. 1-5. However, those skilled in the art will readily appreciate that the detailed description given herein with respect to these Figures is for explanatory purposes only and should not be construed as limiting.

FIG. 1 illustrates an example electronic device 100 that may use the keyboard assembly and keyboard stack-up described above and herein. In a non-limiting example, the electronic device 100 may be a laptop computer having an integrated keyboard 110. The keyboard 110 may include various keys 120. The keys 120 may each be associated with a respective keyboard stack-up such as described herein. Further, each key 120 may be supported by a support structure of a top case such as described below.

While a laptop computer is specifically shown and described, the electronic device 100 may be configured as any electronic device that may utilize the keyboard assembly and/or the keyboard stack-up described herein. For example, the electronic device 100 may be a desktop computer, a tablet computing device, a smartphone, a gaming device, a display, a digital music player, a wearable computing device or display, a health monitoring device, and so on. In addition, while a keyboard is specifically mentioned, the embodiments described herein may be used in a variety of input devices such as, buttons, switches and so on.

Figure 2:
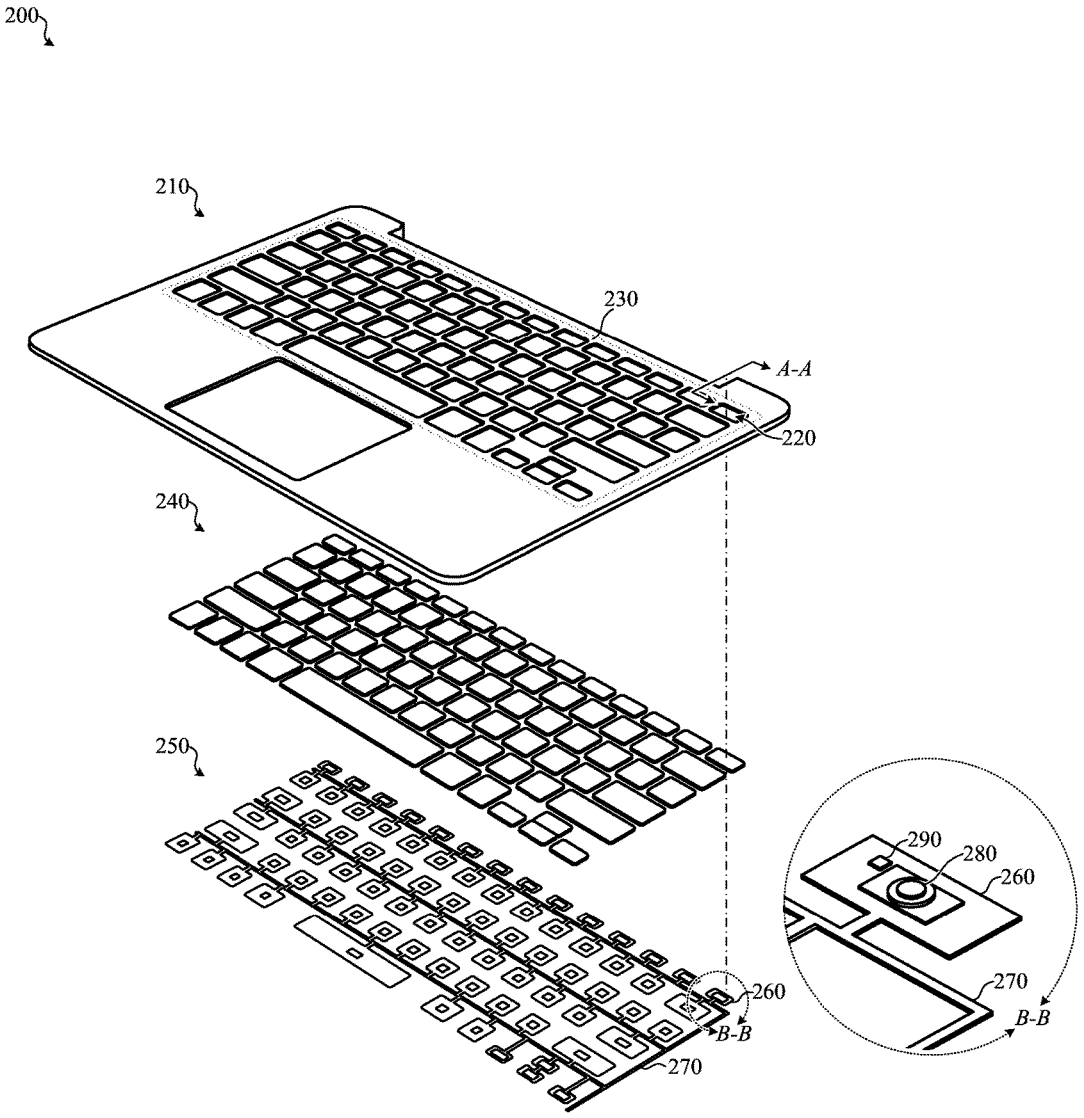
FIG. 2 illustrates an example keyboard assembly according to one or more embodiments of the present disclosure.

FIG. 2 illustrates an exploded view of an example keyboard assembly 200 according to one or more embodiments of the present disclosure. The keyboard assembly 200 may be used with an electronic device, such as, for example, a laptop computer shown in FIG. 1 or other such electronic device.

The keyboard assembly 200 includes a top case 210. The top case 210 may take the form of an exterior protective casing or shell for the electronic device. The top case 210 may also protect the various internal components of the electronic device including a keyboard stack-up array 250.

Top case 210 may be formed as a single, integral component. The top case 210 may be coupled to a bottom case which is not shown for clarity. The top case 210 may have a group of distinct components that may be configured to be coupled to one another. In non-limiting examples, top case 210 may be made from metal, a ceramic, a rigid plastic or another polymer, a fiber-matrix composite, and so on.

The top case 210 may define or otherwise include one or more openings or keyholes 220. The keyholes 220 may be configured to receive keycaps 240 that are associated with each key of a keyboard. The keycaps 240 may partially protrude or otherwise extend from the top case 210 through the keyholes 220. In addition, each keycap 240 may be at least partially surrounded by a portion of the top case 210. Stated another way, the keyholes 220 that are formed in the top case 210 cause ribs 230 to be formed in the top case 210. The ribs 230 are positioned between the keycaps 240 to divide and separate each key of the keyboard. The ribs 230 may provide structural support for the top case 210.

The keyboard assembly 200 also includes a keyboard stack-up array 250. The keyboard stack-up array 250 includes multiple keyboard stack-ups 260 (shown in detail in B-B) secured within or otherwise coupled to a frame 270. In some implementations, the frame 270, or portions of the frame 270 may be flexible or bendable. For example, different portions of the frame 270 may be coupled to individual keyboard stack-ups 260. As such, the frame 270 may enable each individual keyboard stack-up 260 to move independently of one another. Thus, each keyboard stack-up 260 may be inserted into respective keyholes 220 and supported by a support structure of the top case 210.

Each keyboard stack-up 260 in the keyboard stack-up array 250 may be similar to the keyboard stack-up described below. That is, each keyboard stack-up 260 may include a substrate, an in-plane switch (not shown) a dome 280 positioned over the in-plane switch, a light source 290, a signal trace and a power trace.

The frame 270 may have similar pattern or structure as the ribs 230 of the top case 210. Accordingly, the frame 270 may provide added structural support for the top case 210. The frame 270 may have various signal traces and/or power traces formed thereon for each light source 290 and in-plane switch coupled to respective keyboard stack-ups 260.

In alternative embodiments, the keyboard assembly 200 may be used to create a flexible keyboard. In such embodiments, the top case 210 may be omitted or may be formed from a flexible material. The flexible material, and more specifically the flexible keyboard, may have a maximum bend radius such that components (e.g., traces, switches and so on) of the keyboard assembly are not damaged. In other implementations, each component of the keyboard stack-up 260 may be placed or otherwise coupled to a flex.

Figure 3A:
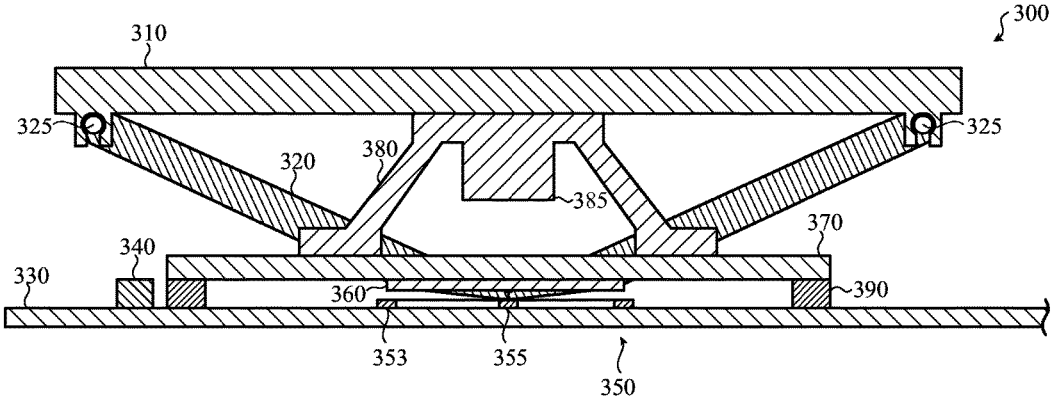
FIG. 3A illustrates an example reduced layer keyboard stack-up including a keycap and a hinge mechanism according to one or more embodiments of the present disclosure.

FIG. 3A illustrates an example reduced layer keyboard stack-up 300 including a keycap 310 and a hinge mechanism 320 according to one or more embodiments of the present disclosure. The keycap 310 may be coupled to the hinge mechanism 320 using one or more retaining features 325. The hinge mechanism 320 enables the keycap 310 to move from an uncompressed state to a compressed state and vice versa. Example hinge mechanisms 320 include, but are not limited to, a butterfly hinge mechanism, a scissor hinge mechanism, a telescoping hinge mechanism, a sliding hinge mechanism and so on. The hinge mechanism 320 may also be coupled to a substrate 330 of the keyboard stack-up 300.

The substrate 330 of the keyboard stack-up 300 may be flexible. In other implementations, the substrate 330 may be a printed circuit board. The various layers (including additional plastic or deflection layers not shown in the figures) of the keyboard stack-up 300 may be laminated or otherwise coupled to a printed circuit board or a flex. Further, some of the connections or traces may be provided on or otherwise formed on the printed circuit board and/or the flex and provided to the components of the keyboard stack-up 300.

Multiple keyboard stack-ups 300 may be coupled together to form a keyboard stack-up array, such as, for example, keyboard stack-up array 250 (FIG. 2). Accordingly, each key of a keyboard may have a discrete keyboard stack-up 300. As such, each key of a keyboard may have its own keycap 310, hinge mechanism 320, light source 340 and so on. Accordingly, each key of the keyboard may be illuminated by its own light source 340 and the illumination of each key may be separately tuned or otherwise adjusted.

Each keyboard stack-up 300 in the array may be inserted into or otherwise coupled to a top case of a keyboard assembly such as described herein. More specifically, a top case of the keyboard assembly may include a ledge or other support structure that is adapted to receive and support an individual keyboard stack-up 300 or multiple keyboard stack-ups 300.

The keyboard stack-up 300 may also include a stiffener. The stiffener may provide additional structural support for the keyboard stack-up 300. The stiffener may be aluminum, stainless steel, plastic or other such material. Stiffeners of varying thicknesses may be used depending on the stiffness of the substrate 330 and/or the desired stiffness of the keyboard stack-up 300. In other implementations, the stiffener may be omitted.

In embodiments where the substrate 330 is a printed circuit board, a stiffener may not be required. Optionally, where the substrate 330 is a flexible substrate (such as a flex circuit), a stiffener may be coupled to the flexible substrate to provide additional structural support for the keyboard stack-up 300 and/or a top case of the electronic device in which the keyboard stack-up 300 is placed. In some embodiments, the flexible substrate or other such flexible material may be coupled to a printed circuit board.

The keyboard stack-up 300 may also include a light source 340. The light source 340 may be coupled to an optional light guide to illuminate the keycap 310. The keycap 310 may also include a glyph on an exposed surface. The glyph may be transparent or substantially transparent to enable light from the light source 340 to pass through the glyph and illuminate the keycap 310. In some implementations, the keycap 310 may be substantially opaque while the glyph is transparent or substantially transparent. In some implementations, the perimeter of the keycap 310 may also be illuminated. The light source 340 is coupled to the substrate 330 and receives power from a power trace that is printed, formed or otherwise disposed in or on the substrate 330. In some embodiments, the light source 340 is a light-emitting diode although other light sources may be used.

The keyboard stack-up 300 also includes an in-plane switch 350. Although an in-plane switch 350 is specifically mentioned, various switches may be used. The in-plane switch 350 may be coupled to the substrate 330. In some implementations, the base of the in-plane switch 350 may be the substrate 330. For example, and as previously explained, the substrate 330 may be a flexible substrate or a flex and the flexible substrate or the flex is the base of the in-plane switch 350.

The contacts (e.g., outer contact 353 and inner contact 355) of the in-plane switch 350 may be planar or substantially planar with respect to a surface of the substrate 330. In other implementations, the contacts of the in-plane switch 350 may protrude or extend from the substrate 330. In yet other implementations, the contacts may be recessed with respect to the substrate 330.

Figure 3B:
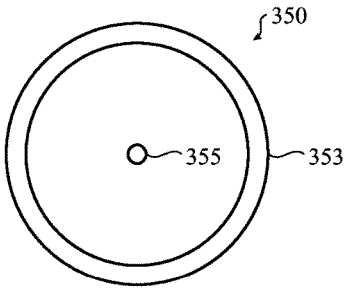
FIG. 3B illustrate a top-down view of an example in-plane switch according to one or more embodiments of the present disclosure.

The in-plane switch 350 may include two (or more) contacts. Specifically, the in-plane switch 350 may have an outer contact 353 and an inner contact 355. As shown in FIG. 3B, which is a top-down view of the in-plane switch 350, the outer contact 353 and the inner contact 355 may be concentric. That is, the inner contact 355 may be surrounded by the outer contact 353.

In some implementations a trace may connect the inner contact 355 with the outer contact 353. Thus, contact by a conductive material on either the inner contact 355 or the outer contact 353 may cause the in-plane switch 350 to conduct a signal. In other implementations, each of the inner contact 355 and outer contact 353 may have separate traces. In such an implementation, a signal is conducted when a conductive material contacts both the inner contact 355 and the outer contact 353. Because the traces are in-plane with the contacts or may otherwise be formed in or on the substrate 330, the outer contact 353 may have a gap that allows the trace of the inner contact 355 to connect with the inner contact 355 but not the outer contact 353.

Referring back to FIG. 3A, when a conductive material 360, such as, for example a silver pad, contacts the inner contact 355 and/or the outer contact 353 (depending on the implementations described above) of the in-plane switch 350 though actuation of the keycap 310 and/or collapse of the dome 380, the conductive material 360 bridges the contacts to create an electrical connection. The electrical connection generates a signal indicative of the received input. In other implementations, the conductive material 360 may short a connection or otherwise draw power down between the inner contact 355 and the outer contact 353 thereby generating a signal indicative of received input.

Although a silver pad is specifically mentioned in the example above, other conductive materials may be used. In addition, once the signal is generated, it may be transmitted on a signal trace formed on, integrated with or otherwise printed on the substrate 330.

The keyboard stack-up 300 also includes a dome 380 coupled to a deflection layer 370 and positioned over the in-plane switch 350. The dome 380 and the deflection layer 370 may also be placed over the light source 340. As such, one or both of the dome 380 and the deflection layer 370 may be transparent or at least partially transparent and may act as a light guide such that light may pass though and illuminate the keycap 310.

The deflection layer 370 may include a conductive material positioned in and/or on a bottom surface. The deflection layer 370 may be thermoplastic polymer such as, for example, polyethylene terephthalate. Although a specific example has been given, the deflection layer 370 may be made from various materials.

In some embodiments, the dome 380 is a rubber dome. In other embodiments, the dome may be a plastic dome, a metal dome or may be made from various other materials. The dome 380 is configured to collapse, be deformed or otherwise compress in response to actuation of the dome 380 and/or the keycap 310. While a dome 380 is specifically shown and described, the dome 380 may be optional or may be replaced by a spring, a plunger on a keycap 310 and other such mechanisms that may be used to deflect or actuate the deflection layer 370 or bridge the contacts of the in-plane switch 350.

As the dome 380 is compressed, a nub 385 or other portion of the dome 380 causes the deflection layer 370, and more specifically, the conductive material 360 on the bottom surface of the deflection layer 370, to deflect toward the contacts of the in-plane switch 350. Once the conductive material 360 comes into contact with the contacts of the in-plane switch 350, a signal indicative of which key or button of the electronic device has been actuated is generated and transmitted along the signal trace of the substrate 330 to an associated electronic device or a dedicated processing element in the keyboard. When the dome 380 returns to its nominal state, the deflection layer 370 also returns to its nominal state and the conductive material 360 is removed from the contacts of the in-plane switch 350.

The keyboard stack-up 300 may also have one or more spacers 390 positioned between the substrate 330 and the deflection layer 370. The spacers 390 may be used to provide separation between the conductive material 360 and the contacts of the in-plane switch 350. In addition, the spacers 390 may assist the deflection layer 370 in returning to its nominal state.

Figure 4:
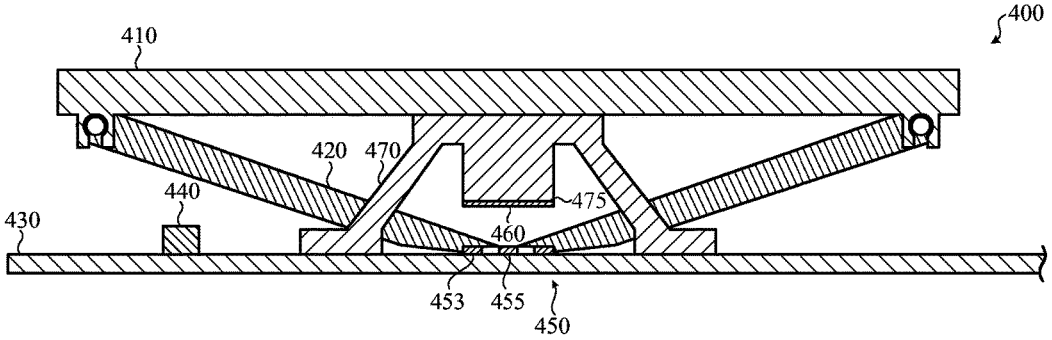
FIG. 4 illustrates an example reduced layer keyboard stack-up including a keycap and a hinge mechanism according to one or more alternate embodiments of the present disclosure.

FIG. 4 illustrates an example reduced layer keyboard stack-up 400 according to one or more alternate embodiments of the present disclosure. The reduced layer keyboard stack-up 400 is generally the same as the reduced layer keyboard stack-up 300 shown and described with respect to FIG. 3A but without the deflection layer 370.

As such, the reduced layer keyboard stack-up 400 includes a keycap 410, a hinge mechanism 420, a substrate 430, an optional light source 440, and an in-plane switch 450. The light source 440 is configured to illuminate the keycap 410 while the in-plane switch 450 is configured to detect actuation of keycap 410 and/or dome 470 of the keyboard stack-up 400. The contacts of the in-plane switch 450 may be concentric. For example, the in-plane switch 450 may have an outer contact 453 and an inner contact 455. The substrate 430 may also include a power trace for providing power to the light source 440 and may include a signal trace for transmitting a signal generated by the in-plane switch 450.

The substrate 430 of the keyboard stack-up 400 may be flexible. In other implementations, the substrate 430 is a printed circuit board. One or more stiffening layers (not shown) may also be applied to various parts of the keyboard stack-up 400 such as described above. The keyboard stack-up 400 also includes a dome 470. The dome 470 may be similar to the dome 380 described above. The dome 470 may be directly coupled, laminated or adhered to the flex or substrate 430.

The keyboard stack-up 400 does not include a deflection layer as the keyboard stack-up 300 of FIG. 3A. However, in lieu of a deflection layer, the dome 470 may include a conductive material 460 disposed on a nub 475 or other surface of the dome 470. In some implementations, the conductive material 460 may be co-molded or otherwise integrated with the dome 470. In other implementations, the conductive material 460 is surface mounted to the dome 470. In yet other implementations, the conductive material 460 may be painted, etched or printed on the nub 475 or other surface of the dome 470. As with the conductive material disclosed above, the conductive material 460 in the present embodiment may be configured to bridge a connection between the contacts of the in-plane switch 450 when the keycap 410 and/or the dome 470 is actuated or collapsed.

Figure 5:
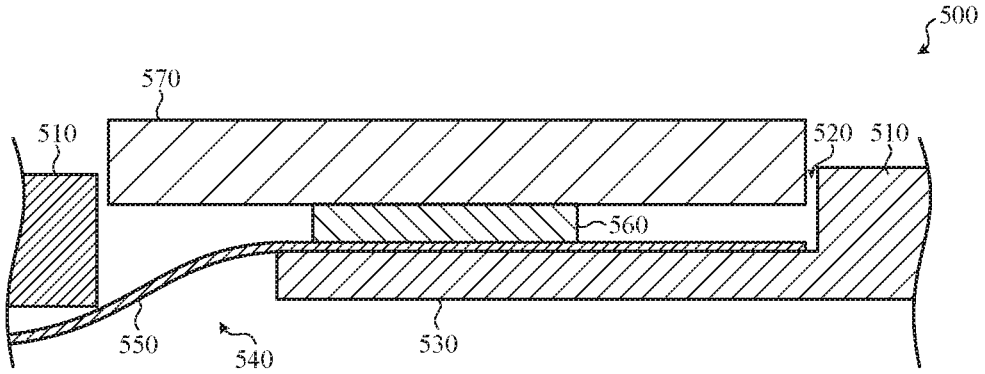
FIG. 5 illustrates a cross-section view of an example keyboard assembly according to one or more embodiments of the present disclosure.

FIG. 5 illustrates a cross-section view of an example keyboard assembly 500 according to one or more embodiments of the present disclosure. The cross-section view shown in FIG. 5 may be taken along A-A of FIG. 2 when the keyboard assembly 200 is assembled.

The keyboard assembly 500 may include a top case 510. The top case 510 may have a first thickness and may further include a keyhole 520 and a support structure 530. The support structure 530 may have a thickness that is less than the thickness of the top case 510.

In some embodiments, the support structure 530 may extend from the top case 510 and may also provide structural support for the top case 510. More specifically, the support structure 530 may extend from the top case 510 and may also extend at least partially into the keyhole 520 to form a ledge. The support structure 530 also defines an opening 540 on a bottom surface of the top case 510. The support structure 530 also supports the substrate 550 (or flex) and the dome of the keyboard stack-up 560.

The opening 540 receives a keyboard stack-up 560 which may be placed on or coupled to the ledge of the support structure 530 such that the support structure is underneath substrate of the keyboard stack-up 560. For example, a respective keyboard stack-up 560 of a keyboard stack-up array (such as the keyboard stack-up array 250 shown in FIG. 2) may be inserted or otherwise threaded through the opening 540 on a bottom of the top case 510. Once inserted, a keycap 570 may be coupled to the keyboard stack-up 560 via the keyhole 520 disposed on a top surface of the top case 510. As such, the support structure 530 provides structural support for the keyboard stack-up 560 and also provides structural support for the keyboard assembly 500.

For example, the support structure 530 may prevent undesired deflection of the keyboard stack-up 560 during use and/or during manufacture and may also prevent a keycap 570 from plunging under the top case 510 or under the ribs (e.g., ribs 230 of FIG. 2) of the top case 510.

As with the other keyboard stack-ups described herein, the keyboard stack-up 560 operates as previously described.

The keyboard stack-up 560, and more specifically the components of the keyboard stack-up 560 may be sealed (e.g., liquid sealed) to the substrate 550 of the keyboard stack-up 560. In some embodiments, the keyboard stack-up 560 may also include one or more air pockets or vents on a bottom surface that permit the structure to cool and to evacuate air under the dome when the dome collapses.

Although discussed herein as a keyboard assembly, it is understood that the disclosed embodiments can be used as an input assembly for any depressible input mechanism such as, for example, a button, and may be used in a variety of input devices and/or electronic devices. That is, the keyboard stack-up, and the components of the keyboard stack-up disclosed herein may be utilized or implemented in a variety of input devices for an electronic device including, but not limited to buttons, switches, toggles, wheels, touch screens and so on.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A keyboard assembly comprising:

a top case defining a keyhole within which a ledge extends partially across the keyhole and defines an opening;

a stack-up positioned on a top surface of the ledge and comprising:

a keycap;

a dome positioned below the keycap; and a switch positioned below the dome; and a flexible substrate operably coupled to the switch and extending through the opening.

2. The keyboard assembly of claim 1, further comprising a signal trace formed on the flexible substrate for detecting actuation of the switch.

3. The keyboard assembly of claim 1, wherein the ledge has a secondary thickness less than a primary thickness of the top case.

4. The keyboard assembly of claim 1, further comprising a deflection layer positioned between the dome and the switch.

5. The keyboard assembly of claim 1, wherein the top case is at least partially flexible.

6. The keyboard assembly of claim 1, further comprising a light source coupled to the flexible substrate.

7. The keyboard assembly of claim 6, further comprising a power trace formed on the flexible substrate for providing power to the light source.

8. The keyboard assembly of claim 6, wherein the light source is a light-emitting diode.

9. An input assembly comprising:

a top case defining a keyhole within which a ledge extends partially across the keyhole and defines an opening;

a keycap positioned at least partially in the keyhole;

a hinge mechanism positioned below and coupled to the keycap;

a switch positioned between the keycap and above the ledge;

a substrate extending from within the keyhole through the opening.

10. The input assembly of claim 9, wherein the hinge mechanism is coupled to the substrate on a first side.

11. The input assembly of claim 10, wherein the substrate is coupled to the ledge on a second side opposite to the first side.

12. The input assembly of claim 9, wherein the switch includes a signal trace and a power trace, wherein a signal is sent along the signal trace in response to the movement of the keycap.

13. The input assembly of claim 12, further comprising:

a light source coupled to the substrate and the power trace.

14. An electronic device comprising:

a casing defining a keyhole;

a support structure extending partially across the keyhole and defining an opening within the keyhole;

an input stackup disposed in the keyhole and comprising:

a keycap;

a switch positioned below the keycap; and a flexible substrate operably coupled to the switch and extending through the opening.

15. The electronic device of claim 14, further comprising a deflection layer positioned between the keycap and the switch.

16. The electronic device of claim 14, wherein switch comprises concentric contacts.

17. The electronic device of claim 14, wherein the casing has a first thickness and the support structure has a second thickness that is less than the thickness of the casing.

18. The electronic device of claim 14, further comprising an actuation mechanism configured to bridge contacts of the switch, the actuation mechanism disposed between the keycap and the switch.

19. The electronic device of claim 18, wherein:

the actuation mechanism comprises conductive material disposed on a surface of the actuation mechanism; and the conductive material is configured to bridge the contacts of the switch.

* * * * *